US009975669B2

(12) United States Patent
Pellerin et al.

(10) Patent No.: US 9,975,669 B2
(45) Date of Patent: May 22, 2018

(54) HINGED CLOSURE DEVICE WITH FIRST OPENING INDICATOR

(71) Applicant: BERICAP, Longvic (FR)

(72) Inventors: Philippe Pellerin, Dijon (FR); Anne-Cécile Ropele, Cheuge (FR)

(73) Assignee: Berlcap, Longvic (FR)

( * ) Notice: Subject to any disclaimer, the term of this patent is extended or adjusted under 35 U.S.C. 154(b) by 548 days.

(21) Appl. No.: 14/579,093

(22) Filed: Dec. 22, 2014

(65) Prior Publication Data

US 2015/0175318 A1 Jun. 25, 2015

(30) Foreign Application Priority Data

Dec. 24, 2013 (FR) ..... 13 63511

(51) Int. Cl.

| | |
|---|---|
| ***B65D 43/00*** | (2006.01) |
| ***B65D 43/02*** | (2006.01) |
| ***B65D 43/16*** | (2006.01) |
| ***B65D 47/08*** | (2006.01) |

(52) U.S. Cl.

CPC ..... *B65D 43/0274* (2013.01); *B65D 43/0235* (2013.01); *B65D 43/16* (2013.01); *B65D 47/0857* (2013.01); *B65D 47/0861* (2013.01); *B65D 2101/0023* (2013.01)

(58) Field of Classification Search

CPC ..... B65D 43/0274; B65D 47/0857; B65D 47/0861; B65D 43/0235; B65D 43/16; B65D 2101/0023

USPC ..... 215/230

See application file for complete search history.

(56) References Cited

U.S. PATENT DOCUMENTS

| | | | | |
|---|---|---|---|---|
| 2,162,752 A * | 6/1939 | Schauer | ..... | B65D 41/3404 215/251 |
| 2,162,754 A | 6/1939 | Schauer | | |
| 2,361,464 A | 10/1944 | Edwards et al. | | |
| D156,280 S | 11/1949 | Rosenthal | | |
| 2,961,119 A | 11/1960 | Leach | | |

(Continued)

FOREIGN PATENT DOCUMENTS

| | | |
|---|---|---|
| CA | 1196606 A1 | 11/1985 |
| CA | 2012047 A1 | 9/1990 |

(Continued)

*Primary Examiner* — Ernesto Grano

(74) *Attorney, Agent, or Firm* — Harness, Dickey & Pierce, PLC

(57) ABSTRACT

A closure device includes a first part forming a fastening base for fastening to the container neck and having at least one peripheral fastening groove and a second part forming a lid, a fastening ring defining a reference geometrical axis, and a hinge connecting the fastening ring to the lid for guiding the lid relative to the fastening ring between a closed position and an open position, the fastening ring being engaged by snap-in action into the fastening groove of the first part. The second part additionally also forms a first-opening indicator and a frangible connection between the first-opening indicator and a peripheral rim flange of the lid, a free space being maintained in the axial direction between the fastening ring and the first-opening indicator in the closed position prior to the first opening, the first-opening indicator being retained by at least one lock zone of the first part so as to be separated from the lid and drop into the free space upon the first opening.

12 Claims, 4 Drawing Sheets

(56) References Cited

U.S. PATENT DOCUMENTS 3,117,701 A 1/1964 Stull
3,463,341 A 8/1969 Fields
D226,555 S 3/1973 Weber
3,823,841 A 7/1974 Lovejoy
3,892,326 A 7/1975 Schneible
3,920,141 A 11/1975 Bojardi
3,944,102 A 3/1976 Grau et al.
4,007,857 A 2/1977 Tomiati et al.
4,299,328 A 11/1981 Ochs et al.
4,322,009 A 3/1982 Mumford
4,322,012 A 3/1982 Conti
4,371,089 A 2/1983 Barendregt
4,418,828 A 12/1983 Wilde et al.
4,442,947 A 4/1984 Banich, Sr.
4,457,438 A 7/1984 Varlet et al.
4,458,820 A 7/1984 Abrams
4,474,301 A 10/1984 Davis
4,487,324 A 12/1984 Ostrowsky
4,489,845 A 12/1984 Aichinger et al.
4,494,663 A 1/1985 Bertaud et al.
D280,802 S 10/1985 Cho
4,546,892 A 10/1985 Couput
4,564,112 A 1/1986 Breuer
4,565,294 A 1/1986 Smith
4,595,123 A 6/1986 Libit
4,598,833 A 7/1986 Herr
4,619,377 A 10/1986 Roos
4,635,823 A 1/1987 Stull
4,709,823 A 12/1987 Beck et al.
4,711,363 A 12/1987 Marino
4,733,787 A 3/1988 Knopf et al.
4,746,025 A 5/1988 Krautkramer et al.
4,747,501 A 5/1988 Greaves
4,795,044 A 1/1989 Beck
4,805,807 A 2/1989 Perne et al.
4,830,224 A 5/1989 Brison
D302,120 S 7/1989 Niwa et al.
4,874,101 A 10/1989 Zalut
4,884,705 A 12/1989 Debetencourt
4,909,404 A 3/1990 Rozenberg
4,936,475 A 6/1990 Montgomery
4,981,230 A 1/1991 Marshall et al.
4,984,699 A 1/1991 Zalut
5,005,718 A 4/1991 Buono
5,007,545 A 4/1991 Imbery, Jr.
5,007,546 A 4/1991 Rose et al.
5,007,555 A 4/1991 Beck
D319,981 S 9/1991 Sledge
5,046,629 A 9/1991 Weile
5,052,568 A 10/1991 Simon
5,058,755 A 10/1991 Hayes
5,080,246 A 1/1992 Hayes
5,085,332 A 2/1992 Gettig et al.
5,090,581 A 2/1992 Rose et al.
5,090,788 A 2/1992 Ingram et al.
5,104,008 A 4/1992 Crisci
5,115,932 A 5/1992 Schneider
5,147,054 A 9/1992 Pehr
5,176,278 A 1/1993 Quarberg
5,219,507 A 6/1993 Ingram et al.
5,289,932 A 3/1994 Dimeo et al.
5,297,688 A 3/1994 Beck et al.
5,297,696 A 3/1994 Bernstein et al.
5,325,983 A 7/1994 Imai et al.
5,335,802 A 8/1994 Brach et al.
5,356,019 A 10/1994 Kelly
5,395,015 A 3/1995 Bolen, Jr. et al.
5,400,912 A 3/1995 Brown et al.
5,417,350 A 5/1995 Koo
5,482,176 A 1/1996 Maietta et al.
D367,424 S 2/1996 Thanisch
D374,821 S 10/1996 Johnson
5,566,864 A 10/1996 Stolz
5,605,240 A * 2/1997 Guglielmini ..... B65D 41/485 215/235
5,641,099 A 6/1997 McLelland et al.
5,648,037 A 7/1997 Franchet et al.
5,660,290 A 8/1997 Hayes
5,662,247 A 9/1997 Rapchak et al.
D385,491 S 10/1997 Mueller et al.
5,685,444 A 11/1997 Valley
5,725,115 A 3/1998 Bosl et al.
5,762,228 A 6/1998 Morgan et al.
5,785,193 A 7/1998 Kobayashi et al.
5,785,213 A 7/1998 Guillot
5,788,100 A 8/1998 Sturk
D398,851 S 9/1998 Gaiser et al.
5,799,840 A 9/1998 Mogard
5,803,286 A 9/1998 Pfefferkorn et al.
5,810,184 A 9/1998 Adams et al.
5,810,185 A 9/1998 Groesbeck
D399,744 S 10/1998 Gross
5,823,377 A 10/1998 Krautkramer
5,839,611 A 11/1998 Obadia et al.
5,846,471 A 12/1998 Thakor et al.
D405,012 S 2/1999 Krautkramer
5,871,111 A 2/1999 Pfefferkorn et al.
5,913,434 A 6/1999 Fukuhara et al.
5,934,496 A 8/1999 Mogard et al.
5,960,992 A 10/1999 Bernstein et al.
5,964,363 A 10/1999 Kelly et al.
5,967,376 A 10/1999 McLelland et al.
5,975,369 A 11/1999 Yurkewicz et al.
5,992,659 A 11/1999 Nofer et al.
D419,447 S 1/2000 Molloy
6,021,912 A 2/2000 Hertrampf
6,050,434 A 4/2000 McNab
6,079,589 A 6/2000 Matsuyama et al.
6,095,382 A 8/2000 Gross
6,116,443 A 9/2000 Parrinello
6,116,477 A 9/2000 Kreiseder et al.
6,119,883 A 9/2000 Hock et al.
6,185,906 B1 2/2001 Mogard et al.
6,223,918 B1 5/2001 Browne
6,279,779 B1 8/2001 Laciacera et al.
6,325,226 B1 12/2001 Krautkramer
6,382,462 B1 5/2002 Ostergaard-Nielsen et al.
6,398,075 B1 6/2002 Laciacera et al.
6,401,982 B1 6/2002 Grittmann
6,422,412 B1 7/2002 Sagawa
D463,280 S 9/2002 Brozell
6,450,357 B1 9/2002 Krautkramer et al.
6,450,367 B1 9/2002 Sittler
6,478,184 B2 * 11/2002 Berge ..... B65D 47/0819 215/235
D480,305 S * 10/2003 Nusbaum ..... D9/435
6,673,298 B2 1/2004 Krueger
D490,315 S 5/2004 Kiser
6,793,101 B2 9/2004 Shinozaki et al.
6,817,276 B1 11/2004 Kowal
6,820,764 B2 11/2004 Miani et al.
D512,634 S 12/2005 Illenberger et al.
7,036,683 B2 5/2006 Dubach
7,077,278 B2 7/2006 Dubach
7,077,294 B2 7/2006 Nusbaum et al.
D530,611 S 10/2006 Nusbaum et al.
D556,575 S 12/2007 Nusbaum et al.
7,344,039 B2 3/2008 Bixler et al.
7,611,025 B2 11/2009 Nusbaum et al.
D623,517 S 9/2010 Pechinot
D625,605 S 10/2010 Bardet
RE42,484 E 6/2011 Kitamura et al.
8,231,018 B2 7/2012 Gassner
D672,651 S 12/2012 Gregory et al.
D672,653 S 12/2012 Antier et al.
D673,041 S 12/2012 Antier et al.
D673,042 S 12/2012 Antier et al.
D673,043 S 12/2012 Antier et al.
8,439,212 B2 * 5/2013 Clodfelter ..... B65D 47/0857 215/235
D702,551 S 4/2014 Wisniewski et al.
D704,067 S 5/2014 Scott et al.
9,415,909 B2 * 8/2016 Druitt ..... B65D 47/0809
D782,310 S * 3/2017 Li ..... D9/434

(56) References Cited

U.S. PATENT DOCUMENTS

| | | | | |
|---|---|---|---|---|
| 2002/0079618 | A1 | 6/2002 | Krueger | |
| 2002/0179605 | A1 | 12/2002 | Miani et al. | |
| 2003/0098285 | A1 | 5/2003 | Gregory et al. | |
| 2005/0173368 | A1 | 8/2005 | Nusbaum et al. | |
| 2005/0189312 | A1 | 9/2005 | Bixler et al. | |
| 2007/0090080 | A1 | 4/2007 | Lohrman et al. | |
| 2007/0251911 | A1 | 11/2007 | Russell | |
| 2007/0284392 | A1 | 12/2007 | Kaess et al. | |
| 2009/0057261 | A1 | 3/2009 | Ma et al. | |
| 2010/0252556 | A1 | 10/2010 | Krautkramer | |
| 2010/0264144 | A1 | 10/2010 | Nusbaum et al. | |
| 2010/0264145 | A1* | 10/2010 | Benoit-Gonin .... | B65D 47/0838 220/265 |
| 2011/0000928 | A1 | 1/2011 | Antier et al. | |
| 2013/0087523 | A1* | 4/2013 | Ziegenhorn ..... | B65D 41/32 215/253 |
| 2013/0270306 | A1 | 10/2013 | Krautkramer | |

FOREIGN PATENT DOCUMENTS

| | | | |
|---|---|---|---|
| CA | 2257573 | A1 | 12/1997 |
| DE | 3139526 | A1 | 4/1983 |
| DE | 3811362 | A1 | 6/1989 |
| DE | 19708909 | A1 | 9/1998 |
| DE | 19712364 | A1 | 10/1998 |
| DE | 19734874 | A1 | 2/1999 |
| DE | 202004015939 | U1 | 12/2004 |
| DE | 102007005595 | A1 | 8/2007 |
| DE | 102007005594 | A1 | 8/2008 |
| EP | 0149496 | A2 | 7/1985 |
| EP | 0460557 | A2 | 12/1991 |
| EP | 0529383 | A2 | 3/1993 |
| EP | 1892194 | A1 | 2/2008 |
| ES | 1002990 | U | 7/1988 |
| FR | 1303608 | A | 9/1962 |
| FR | 2309425 | A1 | 11/1976 |
| FR | 2407140 | A1 | 5/1979 |
| FR | 2558444 | A1 | 7/1985 |
| FR | 2744101 | A1 | 8/1997 |
| FR | 2765194 | A1 | 12/1998 |
| FR | 2911328 | A1 | 7/2008 |
| GB | 1140840 | A | 1/1969 |
| GB | 1522692 | A | 8/1978 |
| GB | 1530158 | A | 10/1978 |
| GB | 1569781 | A | 6/1980 |
| GB | 2159123 | A | 11/1985 |
| GB | 2200619 | A | 8/1988 |
| GB | 2353519 | A | 2/2001 |
| JP | 200172102 | | 3/2001 |
| WO | WO-8303809 | A1 | 11/1983 |
| WO | WO-9217379 | A1 | 10/1992 |
| WO | WO-9602430 | A1 | 2/1996 |
| WO | WO-9942375 | A1 | 8/1999 |
| WO | WO-9962776 | A1 | 12/1999 |
| WO | WO-0027722 | A1 | 5/2000 |
| WO | WO-0076875 | A1 | 12/2000 |
| WO | WO-0142103 | A1 | 6/2001 |
| WO | WO-0154999 | A1 | 8/2001 |
| WO | WO-2005067588 | A2 | 7/2005 |
| WO | WO-2010004195 | A2 | 1/2010 |

* cited by examiner

Fig.1
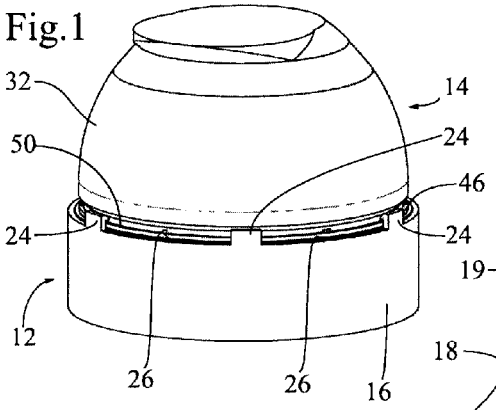
Fig.2
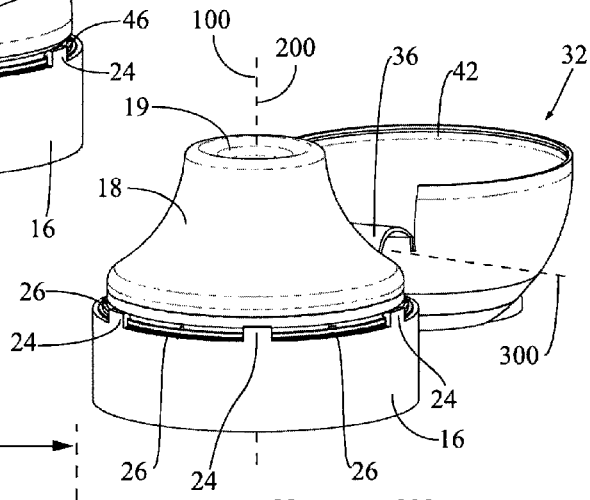
Fig.3
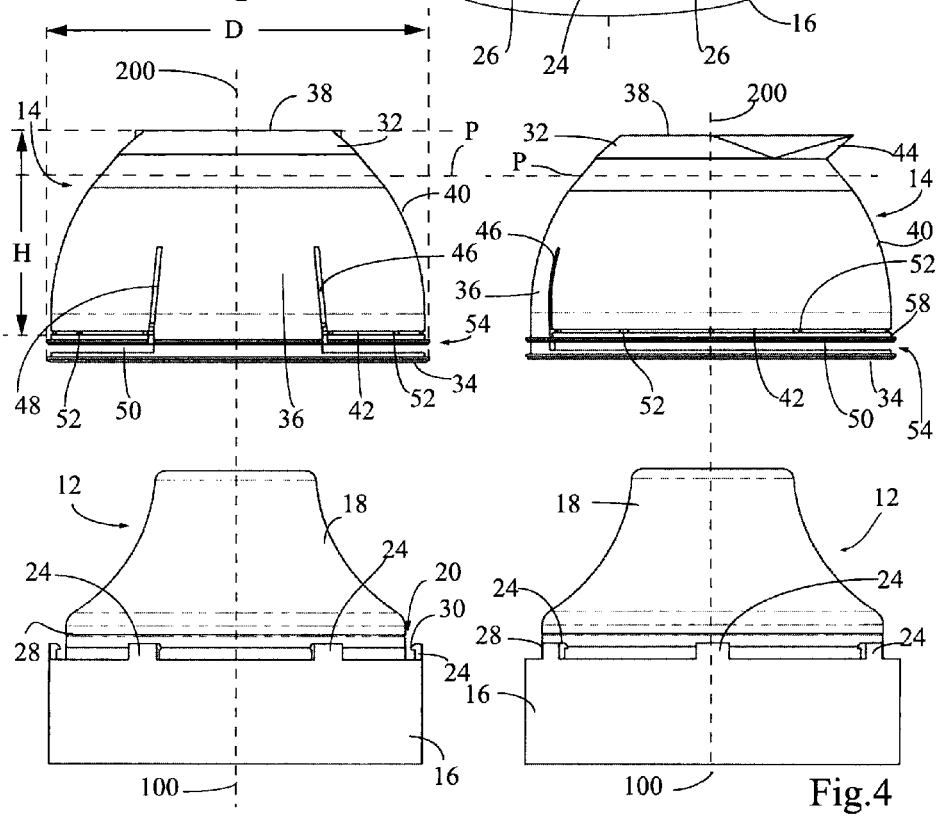
Fig.4

Fig.9
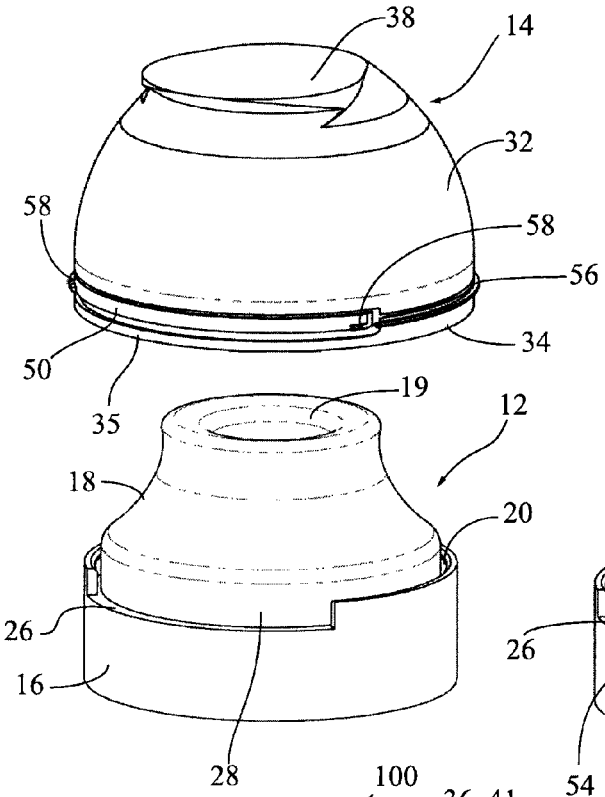
Fig.10
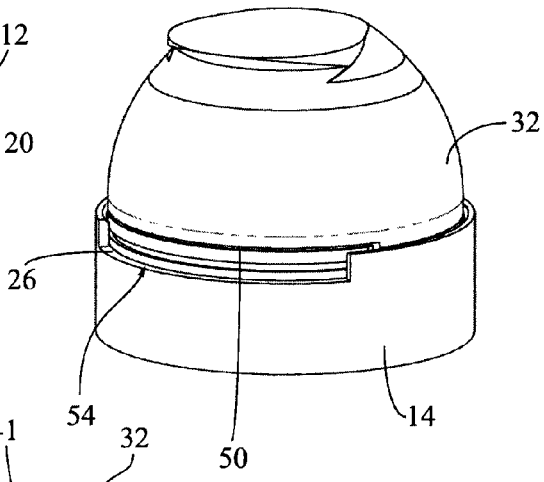
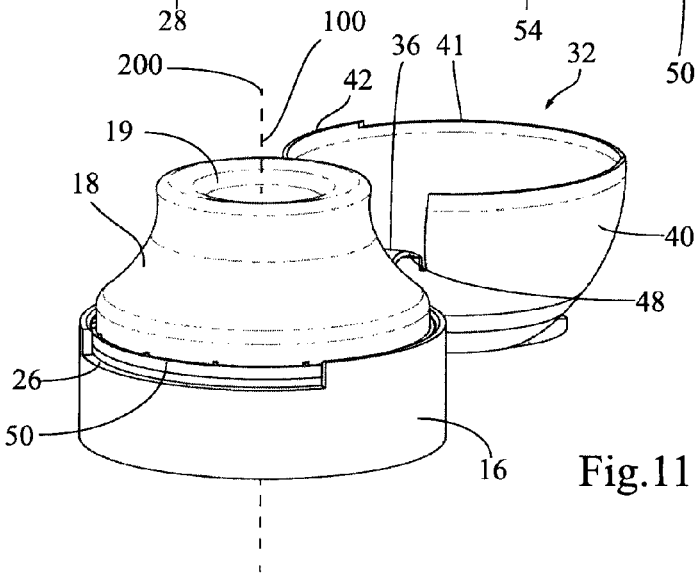
Fig.11

HINGED CLOSURE DEVICE WITH FIRST OPENING INDICATOR

CROSS-REFERENCE TO RELATED APPLICATIONS

This application claims the benefit and priority of French Patent Application Serial No. 1363511, filed on Dec. 24, 2013, which is incorporated by reference herein.

TECHNICAL FIELD

The invention relates to a closure in at least two parts, comprising a base serving a function of fastening to a neck of a container and/or a function of a spout, and a lid hinged to this base.

BACKGROUND

Already known from the prior art are hinged closures in one, two or three parts made of plastic, commonly known as sports caps, that allow the consumer to directly drink the liquid contained in a container and to close it again thereafter. In the document WO 2004/007313, there is an illustration of a closure of this type made in two parts, with a first part forming both a base for fastening on to a container neck and a spout to be taken in the mouth, and a second part forming a lid serving to cover and close off the spout, this second part further comprising a fastening ring and a flexible hinged strap connecting the fastening ring to the lid. An advantage of this type of closure is that it can be manufactured in the closed position, that is to say, without an assembly step of closing the closure wherein the lid is pivoted on its articulation, the assembly of the two parts being done by means of a simple translational movement, during which the ring comes to be inserted by its lower portion into a fastening groove provided for this purpose in the base. The ring is additionally also provided in its upper portion with one or more recesses each receiving a first-opening indicator connected on the one hand to the bottom of the recess and on the other hand to a rim flange of the lid. The intended effect is to bring about, when opening, the breaking of the first-opening indicator into two parts, one connected to the lid and the other to the ring, and, by means of a displacement or deformation of at least one of these two parts, to make the opening detectable by the consumer. In practice, however, it proves to be difficult, on closures of small dimensions, to obtain a displacement or deformation that is detectable by the consumer. This is the reason why, for its commercialisation, this closure has been provided with a break away tab in lieu of the first-opening indicator. Thus, precautions must then be taken in order to ensure that this break away tab does not separate from the closure after opening, which would be detrimental from the standpoint of respect for the environment.

In the document EP 1 892 194 a sports cap in two parts has been proposed, that is to say, a first part forming a base and a lid articulatedly joined to the base by a hinge, and a second part constituting a spout inserted into the base. This cap may also be manufactured in the closed position, by means of axial assembly of the two parts. An annular dead volume is maintained between the two assembled parts, this being a volume that serves to house, after opening a first-opening indicator that is separated from a peripheral wall from the cap. In order to ensure proper assembly while preserving this annular dead volume, it is necessary to provide end stops projecting outward axially from the bottom of the base and against which the spout is positioned. Once again the result thereof is a substantial axial space requirement. In addition, the disappearance of the first-opening indicator does not necessarily allow a consumer unfamiliar with the cap mechanism in question to visually discern whether the latter had already been opened. Finally, the fact that the base and the cap belong to the same part limits the possible variations in colour and material for the portion visible externally, unless this part is manufactured by using a bi-injection process, which would raise the cost thereof.

SUMMARY

The invention aims to overcome all or part of the disadvantages of the prior art as identified here above.

In order to do this, the invention proposes according to a first aspect thereof, a closure device to be integrally fastened to a container neck, the closure device comprising: a first part forming a fastening base for fastening to the container neck and having a peripheral fastening groove; and a second part forming a lid, a fastening ring defining a reference geometrical axis, and a hinge connecting the fastening ring to the lid for guiding the lid relative to the ring between a closed position and an open position, the fastening ring being engaged by snap-in action into the fastening groove of the first part. The second part additionally also forms a first-opening indicator and a frangible connection between the first-opening indicator and a peripheral rim flange of the lid, a free space being maintained in the axial direction between the ring and the first-opening indicator in the closed position prior to the first opening, the first-opening indicator being retained by at least one lock zone of the first part so as to be separated from the lid and drop into the free space upon first opening.

The closure device thus defined can be manufactured in the closed position, by means of axial assembly, and offers a very good view of the first-opening indicator, while also preventing the first-opening indicator from being separated from the closure device following the opening thereof.

The two parts, which in practice are made of plastic material, can be manufactured where appropriate with different materials, for example, materials that are more flexible for the base and more rigid for the lid. It is also possible to choose different colours for the two parts, which would facilitate the viewing of the first-opening indicator and, by providing for alternative colour combinations, provide the ability to identify different drinks in a given range, each with a given pair of colours. One of the two parts may also be transparent.

The peripheral groove is preferably annular and the ring closed, so as to maximise the contact surfaces between the ring and the groove, and thus promote the proper fastening through snap-in action, without requiring dimensional tolerances and costly assembly to be complied with under industrial conditions.

Preferably, the first part is shaped so as to render visible in the closed position prior to the first opening, the first-opening indicator as well as the free space. Thus the first-opening indicator is visible before and after the first opening, in such a manner that the consumer, even if they are not familiar with the closure device, cannot be mistaken as to the state thereof. More specifically, the first-opening indicator has a face turned radially towards the exterior, which is visible prior to the first opening and remains entirely visible after the first opening. No other surface of the first-opening indicator turned radially towards the exterior and which would be invisible prior to the first opening appears after the first opening. It is thus essentially the release and the movement of the first-opening indicator that provides the ability to identify that the first opening has taken place.

According to one embodiment, the first part comprises at least two lock zones, and at least one viewing recess separating the two lock zones, rendering visible in the closed position prior to the first opening, the first-opening indicator as well as the free space.

According to one embodiment, there are more than two lock zones, which are distributed preferably over the entire periphery of the first part, preferably regularly spaced and are separated two by two, by the recesses, of which at least one is a viewing recess rendering visible prior to the first opening, the first-opening indicator as well as the free space. It is thus possible to overcome a constraint related to angular indexing of the first part relative to the second part during the assembly thereof. Preferably, the recesses have an arc length that is greater than the lock zones that they separate, to enable good viewing of the first-opening indicator.

Preferably, the one or more lock zones prevent the removal of the first-opening indicator out of the free space after the first opening, which thereby avoids any risk of ingestion of the first-opening indicator by a child, as well as any risk of contamination.

According to one embodiment, the first-opening indicator has a form shaped in an arc around the reference axis. The angle covered by this arc of a circle can be quite significant, which is favourable for good viewing. According to one embodiment, the circular arc runs over an angular section that is greater than 45°, preferably greater than 60°, and preferably less than 180°, for example of the order of 60°, 90° or 120°. According to another embodiment, the circular arc runs over an angular section that is greater than 180°, preferably from a first lateral edge of the hinge up to an opposite second lateral edge of the hinge. Naturally, angles measuring less than 45° are also possible, for example of the order of 30°, and in particular if the shape, size and/or colour of the tamper evident indicator allow for the proper viewing of the change in position.

Preferably, the hinge is a hinge that is reactive and stable, at least in the open position, which facilitates the use thereof in the open position, in particular for drinking directly from the container, but also for pouring out the contents of the container without the risk of having the lid close. Preferably, the hinge has at least two stable positions corresponding respectively to the open position and the closed position of the lid, which also promotes the proper closure of the lid.

According to one embodiment, the hinge comprises of a strip of material connected by an upper end to a connection zone of the lid and by a lower end to the ring, and opposite lateral edges positioned to face the corresponding lateral rim flanges of the lid. Preferably the hinge in the closed position does not protrude outwards relative to a peripheral wall of the lid. Because it does not protrude outwards in relation to the lid in the closed position, the hinge cannot be damaged by handling shocks. In addition, it offers no outlets for dust or any other contaminants during storage.

The lid preferably has a tongue projecting in a radial direction towards the exterior, radially opposite the hinge, in order to facilitate the opening. Preferably, this tongue remains within the interior of a cylinder that is tangential to an exterior of the ring, in order to prevent it from receiving shocks during the handling and storage. Preferably, this tongue is disposed in an upper zone situated in the closed position opposite the ring relative to a plane that is perpendicular to the reference axis and not intersecting the hinge.

The lid has a top wall preferably planar and a height measured in the closed position between a lower peripheral rim flange of the lid and the top wall, the height being preferably less than the exterior diameter of the ring, preferably less than ⅔ of the exterior diameter of the ring.

According to a preferred embodiment, the first part forms a spout projecting out in the axial direction relative to the fastening groove, the spout preferably having an exterior surface having a rotational symmetry about the reference axis. In this case, the lid preferably has an internal sealing skirt, which comes into resilient interference with an interior or exterior surface of the spout.

Preferably, the closure device is constituted only of two parts as defined here above, although by way of a variant a third part may be envisaged, such as a resilient valve disposed in an opening of the base or of its spout, or an attached spout. Where appropriate, provided on the base is a tamper evident indicator intended for identifying an attempt at separation between the base and the neck of the container.

BRIEF DESCRIPTION OF THE FIGURES

Other characteristic features and advantages of the invention will become apparent upon reading the description which follows, with reference made to the accompanying figures, which illustrate the following:

FIG. 1, is an isometric view of a closure device in two parts, after assembly and in the closed position prior to the first opening, according to a first embodiment of the invention;

FIG. 2, is an isometric view of the closure device of FIG. 1, in the open position;

FIG. 3, is a rear view of the two parts of the closure device of FIG. 1, prior to assembly;

FIG. 4, is a view from the side of the two parts of the closure device of FIG. 1, prior to assembly;

FIG. 9, is an isometric view of a closure device in two parts according to a second embodiment of the invention, prior to assembly in the closed position;

FIG. 10, is an isometric view of the closure device of FIG. 9, after assembly, in the closed position, prior to the first opening;

FIG. 11, is an isometric view of the closure device of FIG. 9, in the open position;

For the sake of greater clarity, identical or similar elements have been identified by identical reference signs on all the figures shown.

DETAILED DESCRIPTION OF AN EMBODIMENT

Figure 5:
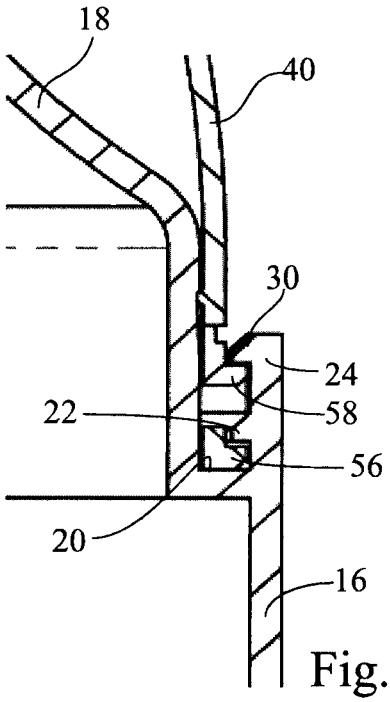
FIG. 5, is a cross sectional view of a detail of the closure device of FIG. 1, in the closed position prior to the first opening.

The closure device 10 represented in FIGS. 1 to 8 is constituted of two parts 12, 14 made out of plastic material and assembled to one another.

The first part 12 comprises a base 16 provided with a relief portion (not shown) for fastening to a container, which may be constituted, for example, and in a known manner, of one or more threads to be used for screwing the base on to a container neck. This base 16 may, if necessary, and also in a known manner, be provided at its lower end with a tamper evident ring cooperating with the neck of the container in order to make visible any attempt at separation between the first part and the neck of the container. The first part 12 further comprises a spout 18 projecting out in the axial direction relative to the base 16, this spout having herein an exterior surface having a rotational symmetry about a reference axis 100 of the first part 12, and a central opening 19.

The first part 12 further has a peripheral annular fastening groove 20 visible in the FIGS. 5 to 8, incorporated in the base and encircling the spout 18. This groove 20 is partially closed by an annular fastening relief portion 22 projecting out radially towards the interior of the groove 20 and towards the spout 18.

The first part 12 also has retaining tabs 24, here six in number, separated from one another by the recesses 26, and projecting out from the base 12 in the axial direction so as to be facing and at a short distance from a cylindrical wall 28 of the spout 18. Each of the retaining tabs 24 forms a lock zone with a hook 30 projecting out radially towards the interior and towards the spout 18.

The second part 14 forms a lid 32, a closed fastening ring 34 defining a reference axis 200 and a hinge 36 connecting the fastening ring 34 to the lid 32 in order to guide the lid 32 relative to the ring 34 between a closed position illustrated in FIG. 1, and an open position illustrated in FIG. 2, by rotation about an axis 300 that is orthoradial in relation to the reference axis 200. The lid 32 has a top wall 38 that is preferably planar and a peripheral wall 40. The interior surface of the top wall may, in a known manner, be provided with a sealing skirt (not shown), that comes into axial contact or preferably radial contact with an interior or exterior wall of the opening 19. The lid 32 has a height H, measured in the closed position between a lower peripheral rim flange 42 of the peripheral wall 40 and the top wall 38, which, in this embodiment measures less than the exterior diameter D of the ring 34, and in this case less than ⅔ of the exterior diameter of the ring. The top wall forms a tongue 44 projecting in a radial direction towards the exterior, radially opposite the hinge 36. This tongue 44 is preferably situated within the interior of a cylinder that is tangential to an exterior periphery of the ring 34, preferably in an upper zone situated in the closed position opposite the ring and the hinge 36 relative to a plane that is perpendicular to the reference axis 200.

The hinge 36 comprises of a strip of material connected by an upper end to a connection zone of the lid 32 and by a lower end to the ring 34, and opposite lateral edges 46, 48 positioned to face the corresponding lateral rim flanges of the lid 32. At least in one zone situated axially between on the one hand, a first plane perpendicular to the reference axis 200 and intersecting the upper end of the strip and on the other hand, a second plane perpendicular to the reference axis 200 and intersecting the lower end of the strip, and extending angularly about the reference axis at 60° on both sides of the lateral edges of the strip, the hinge and the lid in the closed position have a common exterior casing envelope, which is tantamount to saying that the hinge does not protrude outwards relative to the adjacent surface of the peripheral wall of the lid.

A geometric plane P may be defined perpendicular to the reference axis 200, situated between the top wall 38 and the ring 34, and below which the peripheral wall 40 has a spherical exterior casing envelope or is more generally constituted by a surface of revolution about the reference axis 200, in particular a surface of revolution with a generatrix having a concavity turned towards the axis of revolution 200. This plane P is preferably situated above the hinge 36, between this latter and the top wall 38. Preferably, the peripheral wall 40 of the lid, at its lower end, is tangential or substantially tangential to a cylinder of revolution around the reference axis 200.

The second part 14 also comprises a first-opening indicator 50 in the form of a circular arc extending substantially over an angular section that is greater than 180° about the reference axis 200, preferably from a first lateral edge 46 of the hinge 36 up to an opposite second lateral edge 48 of the hinge, without being connected to the latter. The first-opening indicator 50 is connected to the peripheral rim flange 42 of the peripheral wall 40 of the lid by frangible bridges 52, and is positioned axially between the peripheral rim flange 42 and the fastening ring 34. As shown in particular in FIGS. 3 and 4, a free space 54 is maintained in the axial direction between the ring 34 and first-opening indicator 50 in closed position prior to the first opening.

Figure 6:
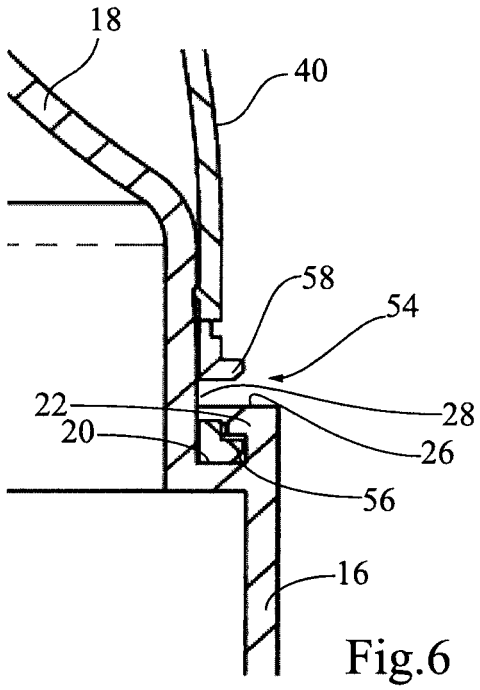
FIG. 6 a sectional view of a detail of the closure device of FIG. 1 in the closed position prior to the first opening.

The two parts 12, 14 are assembled to form the closure device, by ensuring that the reference axes 100, 200 coincide in the position illustrated in FIGS. 3 and 4, and then by bringing the two parts 12, 14 towards each other by axial translational movement. It should be noted that it is not necessary to provide for an angular indexing of the parts about the rotational axes 100, 200 on account of the rotational symmetry of the first part. The fastening ring 34, which is provided with a fastening relief portion 56 projecting out radially towards the exterior, is deformed resiliently upon the passage of the fastening relief portion 22 of the groove 20 and then comes to be engaged irreversibly in the fastening groove 20, the fastening relief portions 22 and 56 prevent the separation of the two parts. As for the first-opening indicator 50 it has a lock shaped portion 58 which, after undergoing resilient deformation upon the passage of the hooks 30, comes to snap in place under the hooks 30 of the retaining tabs 24, as illustrated in FIGS. 5 and 6.

Figure 7:
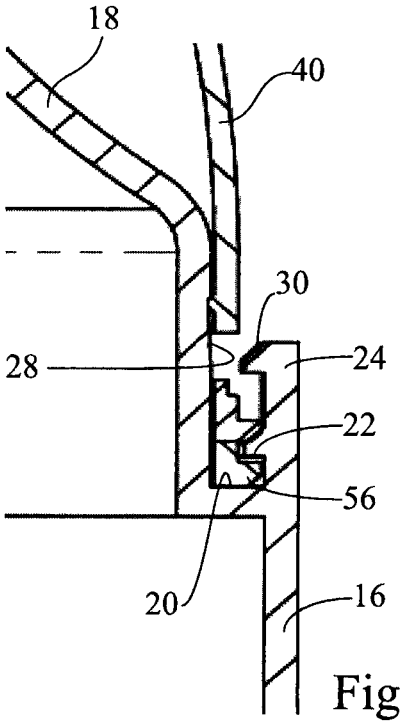
FIG. 7, is a view in the cross-sectional plane of FIG. 5, of a detail of the closure device of FIG. 1, in the closed position after the first opening.
Figure 8:
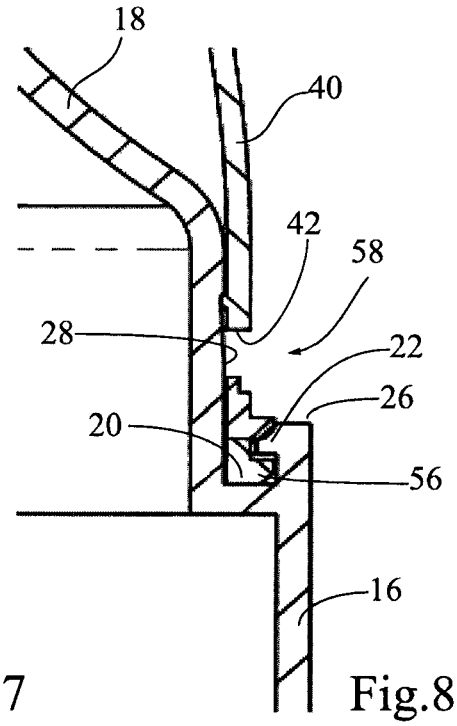
FIG. 8, is a view in the sectional plane of FIG. 6, of a detail of the closure device of FIG. 1, in the closed position after the first opening.
Figure 12:
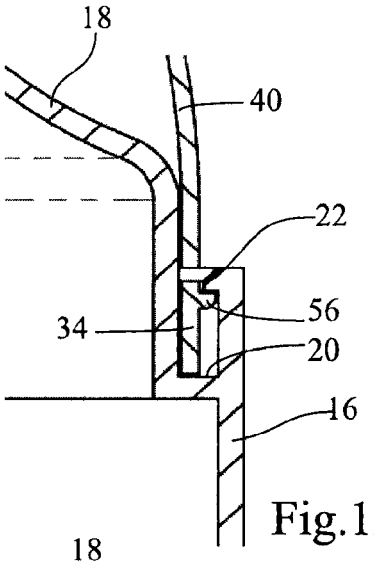
FIG. 12, is a cross sectional view of a detail of the closure device of FIG. 9, in the closed position prior to the first opening.
Figure 15:
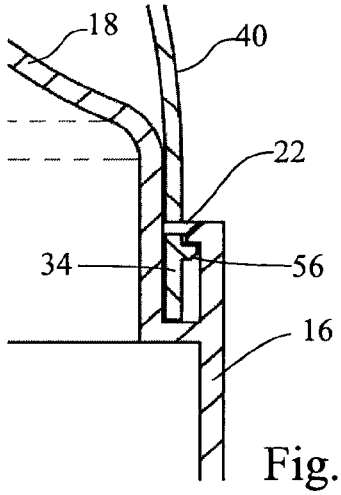
FIG. 15, is a view in the cross sectional plane of FIG. 12 of a detail of the closure device of FIG. 9, in the closed position after the first opening.
Figure 13:
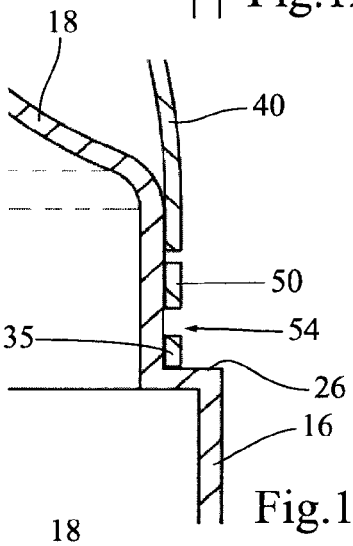
FIG. 13, is a cross sectional view of a detail of the closure device of FIG. 9, in the closed position prior to the first opening.
Figure 16:
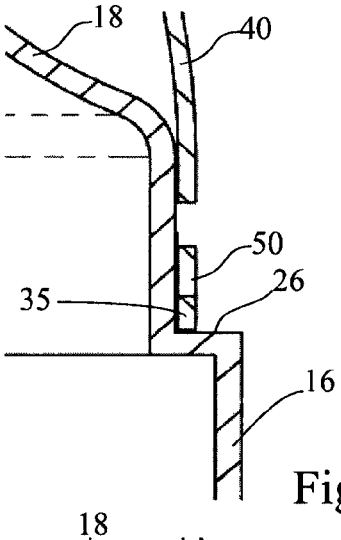
FIG. 16, is a view in the cross sectional plane of FIG. 13 of a detail of the closure device of FIG. 9, in the closed position after the first opening.
Figure 14:
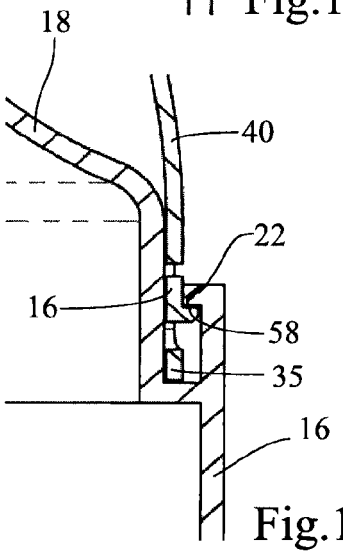
FIG. 14, is a cross sectional view of a detail of the closure device of FIG. 9, in the closed position prior to the first opening.
Figure 17:
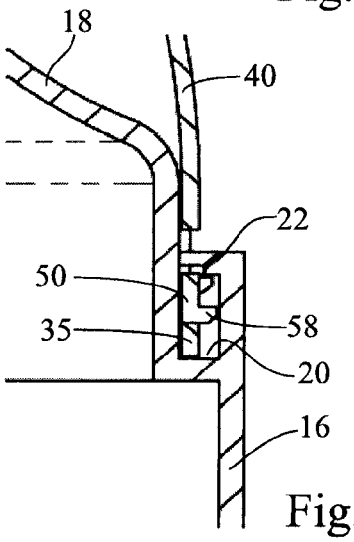
FIG. 17, is a view in the cross sectional plane of FIG. 14 of a detail of the closure device of FIG. 9, in the closed position after the first opening.

At the first opening of the lid 32, the first-opening indicator 50 is retained by the hooks 30 of the retaining tabs 24, and the bridges 52 get torn, separating the first-opening indicator 50 from the lid 32. The first-opening indicator 50 then drops by gravity into the free space 54 and comes to bear against the ring 34. This position is maintained when the lid 32 is closed, as illustrated in FIGS. 7 and 8.

The dropping of the first-opening indicator 50 reveals a space 58 (FIG. 8) between the lid 32 and the first-opening indicator 50, which space is clearly visible from all angles and indicates to the consumer that the closure device 10 has been opened. In a remarkable manner, this space runs over the entire perimeter of the lid, from one lateral edge of the hinge to the other. Also in a remarkable manner, there is neither the appearance nor the disappearance of the first-opening indicator 50, but rather the simple displacement of the latter. Even if they are not familiar with the closure device 10, the consumer noting the positioning of the first-opening indicator 50 on the closed closure device is able to easily verify whether or not it has previously been opened by shaking or turning over the container and observing whether or not there is any displacement of the first-opening indicator, or by listening to the sound of the first-opening indicator moving against the first part.

It is also to be noted that given that the first-opening indicator 50 remains trapped by the retaining tabs 24, the invention avoids the eventual release into the environment of a plastic part which could be the source of further pollution or present a hazard in the event of ingestion by a child.

The open position illustrated in FIG. 2 is preferably a stable position, the hinge 36 is preferably a reactive hinge in the sense that, after breakage of the bridges 52, the hinge 36 itself tends to drive the lid 32 into the open position. Where appropriate, the hinge is reactive only after going beyond a neutral point angular position about the axis 300. This can then be referred to as a bistable hinge, in the sense that following the angular positioning of the lid 32 on one side or the other of the neutral point position, the hinge 36 returns the lid 32 to the closed position or the open position.

A second embodiment of the invention will now be described in relation to the FIGS. 9 to 17. This closure device is largely similar to that shown in FIGS. 1 to 8, and, to avoid repetition, reference will be made to the previous description for the common points.

As illustrated in the figures, the first part 12 of the closure device 10 according to the second embodiment comprises only one recess 26 extending over an angle of less than 180°, and preferably measuring about 60° to 120°, preferably diametrically opposite the hinge 36. On both sides of this recess 26 is formed a groove 20 which runs in the circumferential direction from one edge of the recess 26 to the other, thus over an angular section of more than 180°, which is complementary to that of the recess 26. The groove 20 is provided with a fastening relief portion 22 projecting out radially towards the interior and towards a cylindrical wall 28 of the spout 18.

The second part 14 comprises a lid 32, of which the peripheral wall 40 has a recess 41 for accommodating at least partially a first-opening indicator 50 which is connected to the peripheral wall 40 by frangible bridges 52 situated at the level of the recess 41. The fastening ring 34 of the second part 14 comprises a segment 35 of reduced height at the level of the first-opening indicator 50, in order to leave between the first-opening indicator 50 and the fastening ring 34 a sufficient space 54 that is visible through the recess 26. On either side of the segment 35, the fastening ring 34 has a greater height and is provided with a fastening relief portion 56 projecting out radially towards the exterior, which runs substantially up to the corresponding lateral edge 46, 48 of the hinge 36. The first-opening indicator 50 has in the circumferential direction a length that is slightly greater than the recess 26 and comprises at its ends two lock shaped portions 58, located in the extension of the fastening relief portions 56 of the fastening ring 34. The ends of the fastening groove 20 are thus arranged to face the two lock shaped portions 58, and constitute two lock zones for the first-opening indicator 50. Apart from these two lock zones, the fastening groove 20 serves to accommodate and retain the fastening ring 34.

At the time of assembly, the reference axes 100, 200 of the two parts 12, 14 are aligned and they are positioned angularly relative to one another, before being brought together. The ring 34 comes to snap in place in the groove 20, and fastening relief portions 58 come to snap in place in the lock zones at the two ends of the groove 20.

At the time of the first opening, the first-opening indicator 50 is found to be locked in place at the lock zones, the bridges 52 are torn and the lid 32 is opened while the first-opening indicator 50 drops by gravity into the free space 54, in contact with the narrowed segment 35 of the fastening ring 34, as shown in FIGS. 11 and 15 to 17. This position is maintained during a subsequent closure of the lid 32, so as to ensure the consumer is informed of the opening of the container.

Naturally, a number of different variants are possible. In order to limit the deformation through bending of the first-opening indicator 50 during the tearing of the bridges 52, it may be advantageous to position them only in the proximity of the ends of the first-opening indicator and the lock shaped portions 58.

The shape of the hinge 36 and that of the lid 32, which in the embodiments presented have been chosen in order to provide good mechanical strength to the second part 14 and to minimise the consumption of material may, however, vary based in particular on aesthetic considerations. The spout 18 may be of any type and is not necessarily centered on the reference axis 200 of the second part.

In one variant of the first embodiment, it is possible to provide for the annular fastening relief portion 22 provided on the first part 12 for the fastening of the ring 34, to be projecting out radially towards the exterior from the cylindrical wall 28 of the spout. Similarly, the clip hooks 30 may be disposed on the cylindrical wall 28 of the spout, and oriented radially towards the exterior. The retaining tabs 24 then have only a function of retaining the ring 34 and the first-opening indicator 50. This remark holds true in a similar manner for the second embodiment.

Naturally, the invention is applicable to closure devices having varying external forms and shapes.

The invention claimed is:

1. A closure device to be integrally fastened to a container neck, the closure device comprising:

a first part forming a fastening base for fastening to the container neck and having a peripheral fastening groove;

a second part forming a lid, a fastening ring defining a reference geometrical axis, and a hinge connecting the fastening ring to the lid for guiding the lid relative to the fastening ring between a closed position and an open position, the fastening ring being engaged by snap-in action into the fastening groove of the first part, wherein the second part also forms a first-opening indicator and a frangible connection between the first-opening indicator and a peripheral rim flange of the lid, a free space being maintained in the axial direction between the fastening ring and the first-opening indicator in the closed position prior to the first opening, the first-opening indicator being retained by one or more lock zones of the first part so as to be separated from the lid and drop into the free space upon the first opening;

wherein the first part is shaped so as to render visible in the closed position prior to the first opening, the first opening indicator as well as the free space, and wherein the one or more lock zones of the first part comprise at least two lock zones for clipping the first-opening indicator, and at least one viewing recess separating the two lock zones and rendering visible in the closed position prior to the first opening, the first-opening indicator as well as the free space.

2. The closure device according to claim 1, wherein the one or more lock zones of the first part include more than two lock zones separated two by two by recesses, at least one of the recesses being a viewing recess rendering visible prior to the first opening, the first-opening indicator as well as the free space.

3. The closure device according to claim 2, wherein the more than two lock zones are distributed over the entire periphery of the first part.

4. The closure device according to claim 1, wherein the one or more lock zones prevent the removal of the first-opening indicator after the first opening.

5. The closure device according to claim 1, wherein the first-opening indicator has a form shaped in a circular arc around the reference axis.

6. The closure device according to claim 5, wherein the circular arc runs over an angular section that is greater than 45° about the reference axis.

7. The closure device according to claim 6, wherein the circular arc runs over an angular section that is less than 180°.

8. The closure device according to the claim 5, wherein the circular arc runs over an angular section that is greater than 180° about the reference axis.

9. The closure device according to the claim 8, wherein the circular arc runs over an angular section that runs from a first lateral edge of the hinge up to an opposite second lateral edge of the hinge.

10. The closure device according to claim 1, wherein the hinge comprises of a strip of material connected by an upper end to a connection zone of the lid and by a lower end to the fastening ring, and opposite lateral edges positioned to face corresponding lateral rim flanges of the lid.

11. The closure device according to claim 10, wherein in the closed position the hinge does not project outwards relative to a peripheral wall of the lid.

12. A closure device to be integrally fastened to a container neck, the closure device comprising:

a first part forming a fastening base for fastening to the container neck and having a peripheral fastening groove;

a second part forming a lid, a fastening ring defining a reference geometrical axis, and a hinge connecting the fastening ring to the lid for guiding the lid relative to the fastening ring between a closed position and an open position, the fastening ring being engaged by snap-in action into the fastening groove of the first part;

wherein the second part also forms a first-opening indicator and a frangible connection between the first-opening indicator and a peripheral rim flange of the lid, a free space being maintained in the axial direction between the fastening ring and the first-opening indicator in the closed position prior to the first opening, the first-opening indicator being retained by one or more lock zones of the first part so as to be separated from the lid and drop into the free space upon the first opening;

wherein the hinge comprises a strip of material connected by an upper end to a connection zone of the lid and by a lower end to the fastening ring, and opposite lateral edges positioned to face corresponding lateral rim flanges of the lid, and wherein in the closed position, the hinge does not project outwards relative to a peripheral wall of the lid.

* * * * *